US010450716B2

(12) United States Patent
Behmlander et al.

(10) Patent No.: US 10,450,716 B2
(45) Date of Patent: Oct. 22, 2019

(54) POWER LIMITING STRESS-STRAIN MONITOR SYSTEM AND METHOD FOR MACHINE

(71) Applicant: Caterpillar Inc., Peoria, IL (US)

(72) Inventors: Matthew Behmlander, Metamora, IL (US); Jeremy Roe Hammar, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 274 days.

(21) Appl. No.: 15/382,923

(22) Filed: Dec. 19, 2016

(65) Prior Publication Data

US 2018/0171593 A1 Jun. 21, 2018

(51) Int. Cl.
*E02F 3/08* (2006.01)
*E02F 3/30* (2006.01)
*E02F 9/26* (2006.01)

(52) U.S. Cl.
CPC ..... *E02F 3/308* (2013.01); *E02F 9/268* (2013.01)

(58) Field of Classification Search
None
See application file for complete search history.

(56) References Cited

U.S. PATENT DOCUMENTS 6,314,818 B1 * 11/2001 Mandon ..... E02F 3/34 73/781
9,243,381 B2 1/2016 Behmlander et al.
2014/0032060 A1 * 1/2014 Zinke ..... B66C 23/78 701/50
2017/0212513 A1 * 7/2017 Iida ..... B60W 50/02

* cited by examiner

*Primary Examiner* — John Olszewski
*Assistant Examiner* — Gerrad A Foster
(74) *Attorney, Agent, or Firm* — Oblon, McClelland, Maier & Neustadt

(57) ABSTRACT

A power limiting stress-strain monitor system for a machine includes at least one stress-strain sensor supported on a structural component of the machine. The power limiting stress-strain monitor system also includes an electronic controller including a processor and a memory. The processor receives a signal from the stress-strain sensor, determines a degree of stress-strain at a location of the stress-strain sensor based on the signal, identifies a machine system associated with the stress-strain, and modifies a control signal to the machine system based on the degree of stress-strain.

19 Claims, 2 Drawing Sheets

POWER LIMITING STRESS-STRAIN MONITOR SYSTEM AND METHOD FOR MACHINE

TECHNICAL FIELD

The present disclosure relates generally to a power limiting stress-strain monitor system, and more particularly to a system and method for identifying a structural stress-strain on a machine and modifying power to avoid or slow occurrence of a structural failure.

BACKGROUND

Heavy equipment typically operates in harsh environments, including rugged terrain. As a result of this, and the operating conditions of the equipment, the structural components of the equipment are often subject to stress-strain. Certain machine systems, such as hydraulic power systems, mechanical power systems, and electro-mechanical power systems, for example, may generate movements and forces that contribute to stress-strain in particular areas, such as portions of the machine frame, of the equipment. Over time, the stress-strain may progress and potentially lead to structural failure. A failure can result in significant costs, particularly associated with down-time of the equipment.

U.S. Pat. No. 9,243,381 to Behmlander et al. discloses an erosion monitoring system for a ground engaging tool. In particular, the erosion monitoring system has a sensor embedded within a replaceable cutting edge of the ground engaging tool. A controller is in wireless communication with the sensor and configured to monitor a wear rate of the cutting edge based on signals from the sensor. A notification may be generated based on the monitored wear rate.

As should be appreciated, there is a continuing need to monitor stress-strain on machine components and proactively address potential stress-strain failure.

SUMMARY OF THE INVENTION

In one aspect, a power limiting stress-strain monitor system for a machine includes at least one stress-strain sensor supported on a structural component of the machine. The power limiting stress-strain monitor system also includes an electronic controller including a processor and a memory. The processor receives a signal from the stress-strain sensor, determines a degree of stress-strain at a location of the stress-strain sensor based on the signal, identifies a machine system associated with the stress-strain, and modifies a control signal to the machine system based on the degree of stress-strain.

In another aspect, a machine having a power limiting stress-strain monitor system supported thereon is provided. The machine includes a machine frame, ground-engaging propulsion elements supported on the machine frame, and an electronic controller including a processor and a memory. The processor receives a signal from the stress-strain sensor, determines a degree of stress-strain at a location of the stress-strain sensor based on the signal, identifies a machine system associated with the stress-strain, and transmits a reduced power control signal to the machine system based on the degree of stress-strain.

In yet another aspect, a power limiting method using a power limiting stress-strain monitor system for a machine includes steps of supporting the stress-strain sensor on a structural component of the machine, and receiving a signal from the stress-strain sensor at an electronic controller. The method also includes steps of determining a degree of stress-strain at a location of the stress-strain sensor based on the signal using a processor of the electronic controller, identifying a machine system associated with the stress-strain using the processor, and modifying a control signal to the machine system based on the degree of stress-strain.

DETAILED DESCRIPTION

Figure 2:
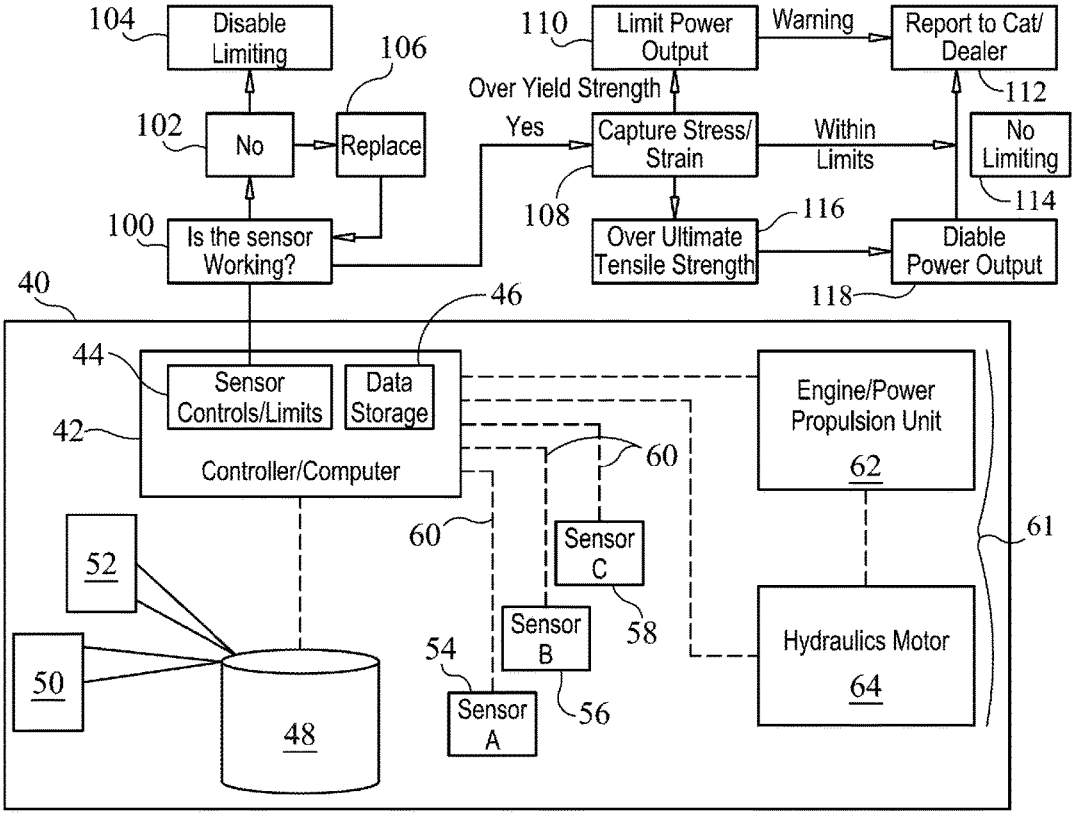
FIG. 2 is a block diagram of a stress-strain monitor system for use with the machine of FIG. 1.

An exemplary machine, according to the present disclosure, is shown generally at 10. The machine 10 includes a machine frame 12 supporting various machine systems and components, including, for example, an operator control station 14, an engine 16, and a propulsion system 18, including ground engaging propulsion elements 20. The machine 10 may also include a hydraulic power system 22, which may be powered by the engine 16 and used to, in turn, power the propulsion system 18 and/or an implement or tool 24 of the machine 10. Additionally, or alternatively, the machine 10 may include a mechanical power system or an electro-mechanical power system. Turning now to FIG. 2, the machine 10 may also include an electronic control system 40, including an electronic controller 42, for electronically monitoring and controlling the various machine systems and components.

The electronic controller 42 may be of standard design and may include a processor 44, such as, for example, a central processing unit, a memory 46, and an input/output circuit that facilitates communication internal and external to the electronic controller 42. The processor 44, for example, may control operation of the electronic controller 42 by executing operating instructions, such as, for example, computer readable program code stored in the memory 46, wherein operations may be initiated internally or externally to the electronic controller 42.

Control schemes may be utilized that monitor outputs of systems or devices, such as, for example, sensors, actuators, or control units, via the input/output circuit to control inputs to various other systems or devices. Memory 46, as used herein, may comprise temporary storage areas, such as, for example, cache, virtual memory, or random access memory, or permanent storage areas, such as, for example, read-only memory, removable drives, network/internet storage, hard drives, flash memory, memory sticks, or any other known volatile or non-volatile data storage devices. One skilled in the art will appreciate that any computer based system or device utilizing similar components for controlling the machine systems or components described herein, is suitable for use with the present disclosure.

According to the present disclosure, the electronic control system 40 may include or access a database 48. The database 48, and/or memory 46, may be accessed by the electronic controller 42 to implement various control strategies for the machine 10. For example, the electronic controller 42 may be configured to execute a power limiting stress-strain monitoring strategy, as taught herein. As such, the database 48 may store a first data table 50 that may include associations of stress-strain signals to degrees of stress-strain. A second data table 52 may also be stored in the database 48 and may include associations of stress-strain to one or more machine systems.

Figure 1:
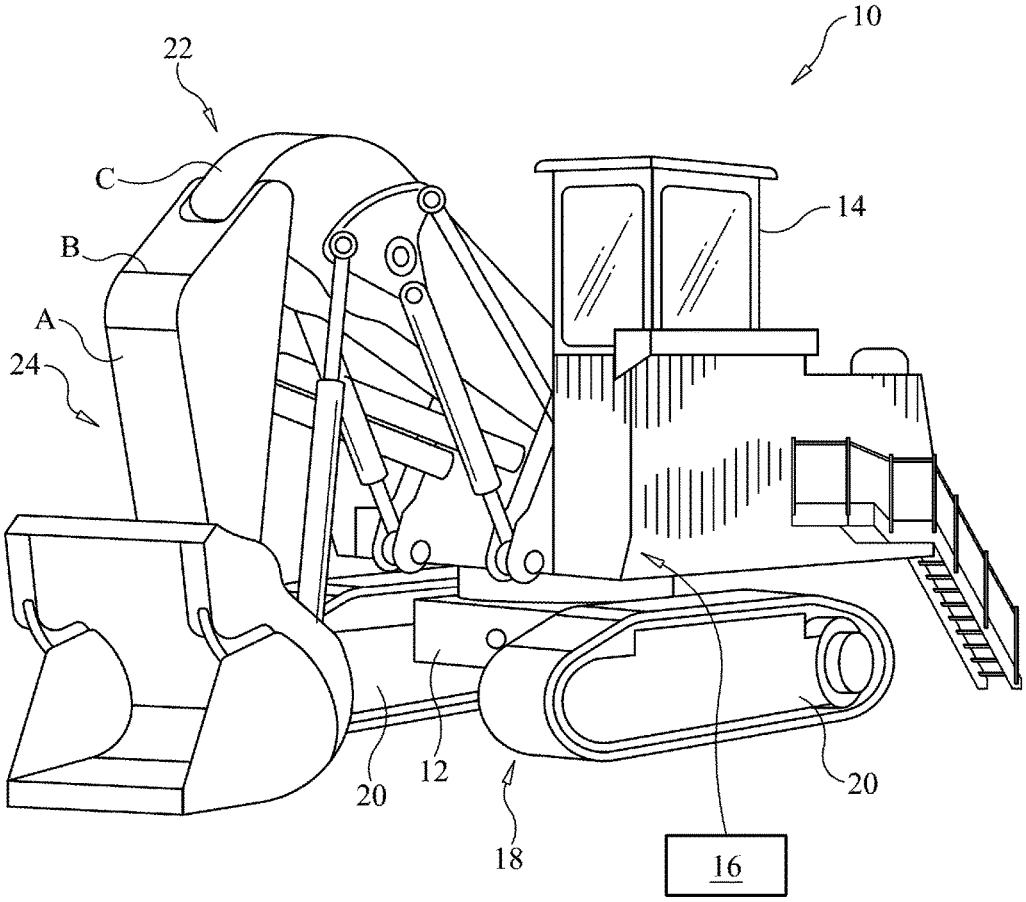
FIG. 1 is a schematic diagram of a machine that may be configured with a stress-strain monitor system, according to the present disclosure.

At least one of stress-strain sensors 54, 56, 58 may be supported on a structural component, such as the machine frame 12 of FIG. 1. For example, the stress-strain sensors 54, 56, 58 may be positioned at various locations, for example, locations A, B, C on the machine frame 12, as shown in FIG. 1, that are known or suspected areas of stress-strain. The stress-strain sensors 54, 56, 58 may be any of a variety of known sensors or devices, such as, for example, strain gauges, for measuring stress and/or strain acting on components. The measured stress-strain may be transmitted from the stress-strain sensors 54, 56, 58 to the electronic controller 42, or other control device, via one of various communication lines 60, such as, for example, wired and/or wireless communication lines. As a result of the signals received, the electronic controller 42 may be configured to create and/or modify control signals to various machine systems, such as, for example, a power system 61, which may include an engine system 62 and/or a hydraulic power system 64, and/or another mechanical power system or electro-mechanical power system.

A sensor control strategy, which may be executed by processor 44, may include a step of determining whether or not the stress-strain sensor 54, 56, 58 is working, at Box 100. If the stress-strain sensor 54, 56, 58 is not working, as determined at Box 102, the power limiting strategy described herein will not be implemented, at Box 104, and the stress-strain sensor 54, 56, 58 should be replaced, at Box 106. If the stress-strain sensor 54, 56, 58 is working, the stress-strain value or reading is captured, at Box 108. If the stress-strain indication is over a yield strength, power output is limited, at Box 110, and a warning or notification may be reported, at Box 112. If the stress-strain is within limits, no power output limiting is applied, at Box 114. If, however, the stress-strain is over the ultimate tensile strength, as indicated at Box 116, power output may be disabled, at Box 118. A machine down warning or notification may be reported.

Figure 3:
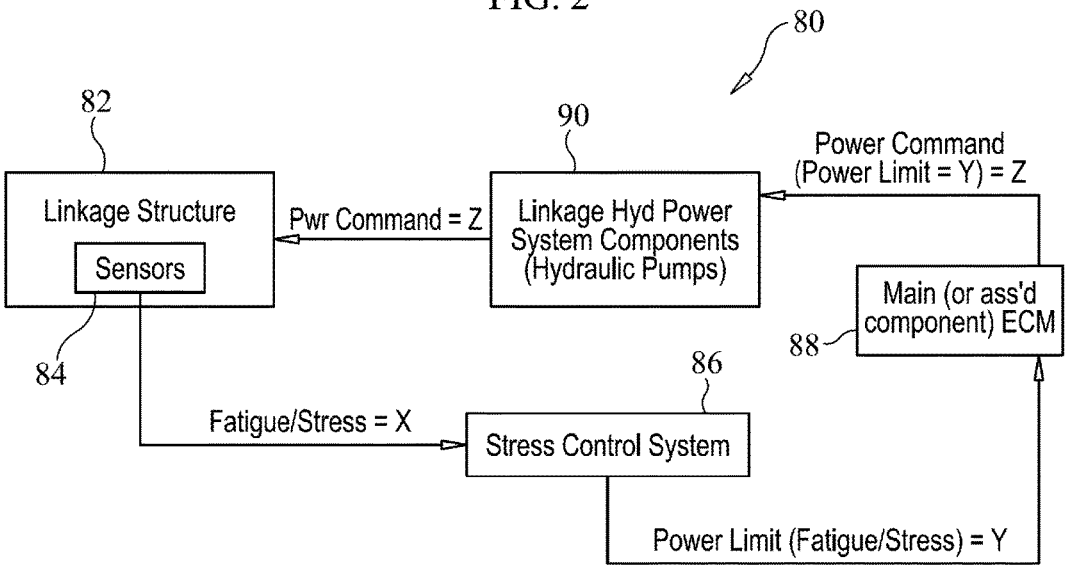
FIG. 3 is a block diagram illustrating a closed loop stress-strain monitoring strategy, according to the present disclosure.

Turning now to FIG. 3, a closed loop algorithm is illustrated using a simplified block flow diagram 80. According to the present disclosure, the processor 44 may execute the closed loop algorithm 80 including a step of receiving a signal from a sensor 84, such as one or more of the stress-strain sensors 54, 56, 58 described above (Block 82). A stress-strain monitor system or module, shown at Block 86, may then determine a degree of stress-strain at a location of the sensor 84.

In particular, the stress-strain monitor system, represented at Box 86, may determine the degree of stress-strain based on the received signal and data provided in the first data table, at 50 of FIG. 2. The first data table 50 may include associations of stress-strain signals to degrees of stress-strain. Also at Box 86, the processor 44 may identify one or more machine systems associated with the stress-strain, such as by accessing the second data table 52 of FIG. 2, which may include associations of stress-strain to one or more machine systems.

At Box 86 and/or Box 88, an electronic controller, which may be similar to electronic controller 42, may receive a command or set of instructions for power limiting a machine system, such as a power system 21, that may be associated with the stress-strain. That is, the electronic controller may generate a reduced power control signal to one of a variety of different machine system as a result of identified stress-strain or identified stress-strain that has reached a threshold value (see Box 90). The machine system contributing to, or associated with, the stress-strain may receive and thereafter operate based on a modified control signal that results in less power delivered by the machine system, such as a machine power system 61. The level of power reduction may be correlated to the degree of stress-strain that was identified.

Further, the processor 44 may identify a failure mode of the stress-strain sensor 54, 56, 58, and refrain from modifying the control signal to the machine system, such as power system 61, as a result of the identified failure mode. For example, the processor 44 may be configured to identify an improper signal from the stress-strain sensor 54, 56, 58, which may indicate a failure mode of the stress-strain sensor 54, 56, 58. These improper signals may be stored in first data table 50, which includes associations of stress-strain signals to degrees of stress-strain. A notification corresponding to the failure mode of the stress-strain sensor 54, 56, 58 and/or corresponding to the degree of stress-strain identified may be transmitted to the operator, an off-board entity, or another entity.

INDUSTRIAL APPLICABILITY

The present disclosure relates generally to monitoring stress-strain on structural components of a machine. Further, the present disclosure is applicable to determining a degree of the stress-strain and identifying one or more machine components associated with or contributing to the stress-strain. Based on the degree of the stress-strain, power to applicable machine systems may be limited.

Referring generally to FIGS. 1-3, an exemplary machine including a power limiting stress-strain monitoring system is shown generally at 10. The machine 10 includes a machine frame 12 supporting various machine systems and components, including, for example, an operator control station 14, an engine 16, and a propulsion system 18, including ground engaging propulsion elements 20. The machine may also include a hydraulic power system 22, which may be powered by the engine 16 and used to, in turn, power the propulsion system 18 and/or an implement or tool 24 of the machine 10. The machine 10 may also include an electronic control system 40, including an electronic controller 42, for electronically monitoring and controlling the machine systems and components.

At least one of stress-strain sensors 54, 56, 58 may be supported on a structural component, such as the machine frame 12, of the machine 10. For example, the stress-strain sensors 54, 56, 58 may be positioned at various locations on the machine frame 12 that are known or suspected areas of stress-strain. The stress-strain sensors 54, 56, 58 may continually or intermittently generate a signal to the electronic controller 42, indicative of stress-strain at the location or area of the stress-strain sensors 54, 56, 58.

Heavy equipment, such as machine 10, typically operates in harsh environments, including rugged terrain. As a result of this, and the operating conditions of the equipment, the structural components of the equipment are often subject to stress-strain. Certain machine systems, such as, for example, the engine system 62 and hydraulic power system 64, may generate movements and forces that contribute to stress-strain in particular areas, such as portions of the machine frame 12, of the equipment. Over time, the stress-strain may progress and potentially lead to structural failure. A failure can result in significant costs, particularly associated with down-time of the equipment.

According to the present disclosure, the electronic controller 42 may execute a closed loop algorithm 80 including a step of receiving a signal from a sensor 84, such as one of the stress-strain sensors 54, 56, 58. The processor 44 may then determine a degree of stress-strain at a location of the sensor 84 based on the signal and the first data table 50, which may include associations of stress-strain signals to degrees of stress-strain. At Box 86, the processor 44 may identify the machine system associated with the stress-strain, such as by accessing the second data table 52, which may include associations of stress-strain to one or more machine systems. The processor 44 may then limit or reduce a power control signal, or reduced power control signal, to the identified machine system to reduce or slow the progression of the stress-strain.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A power limiting stress-strain monitor system for a machine, including:

at least one stress-strain sensor supported on a structural component of the machine; and an electronic controller including a processor and a memory, wherein the processor is configured to:

receive a signal from the stress-strain sensor, determine a degree of stress-strain at a location of the stress-strain sensor based on the signal, determine whether the degree of stress-strain is over a yield strength, identify a machine system configured to control the structural component of the machine associated with the stress-strain, and modify a power control signal to the machine system when the degree of stress-strain is over the yield strength, wherein the power control signal is a reduced power control signal to limit an output power amount of the machine system applied to control the structural component of the machine without disabling the output power of the machine system, and wherein an amount of the limit to the output power amount correlates to the degree of stress-strain.

2. The power limiting stress-strain monitor system of claim 1, wherein the machine system is one of a hydraulic power system, mechanical power system, and an electro-mechanical power system.

3. The power limiting stress-strain monitor system of claim 1, wherein the processor identifies a failure mode of the stress-strain sensor, and disallows transmission of the reduced power control signal to the machine system as a result of the identified failure mode.

4. The power limiting stress-strain monitor system of claim 1, wherein the processor executes a closed loop algorithm including said determining the degree of stress-strain, said determining whether the degree of stress-strain is over a yield strength, said identifying the machine system configured to control the structural component of the machine associated with the stress-strain, and said modifying the power control signal to the machine system when the degree of stress-strain is over the yield strength.

5. The power limiting stress-strain monitor system of claim 1, wherein a notification corresponding to the stress-strain is transmitted to an offboard entity.

6. The power limiting stress-strain monitor system of claim 1, further including a first data table stored in the memory and including associations of stress-strain signals to degrees of stress-strain.

7. The power limiting stress-strain monitor system of claim 1, further including a second data table stored in the memory and including associations of stress-strain to one or more machine systems.

8. The power limiting stress-strain monitor system of claim 1, wherein the structural component of the machine is a machine frame.

9. A machine having a power limiting stress-strain monitor system supported thereon, including:

a machine frame;

ground-engaging propulsion elements supported on the machine frame;

at least one stress-strain sensor supported on the machine frame; and an electronic controller including a processor and a memory, wherein the processor is configured to:

determine a degree of stress-strain at a location of the stress-strain sensor based on a signal from the stress strain sensor, determine whether the degree of stress-strain is over a predetermined threshold, identify a machine system configured to accommodate the stress-strain, transmit a reduced power control signal to the machine system when the degree of stress-strain is over the predetermined threshold, the reduced power control signal being to limit an output power amount of the machine system to move the structural component of the machine, and control the machine system, based on the reduced power control signal, according to the limited output power amount, without disabling the output power of the machine system, wherein an amount of the limit to the output power amount correlates to the degree of stress-strain.

10. The machine of claim 9, wherein the machine system is one of a hydraulic power system, a mechanical power system, and an electro-mechanical power system.

11. The machine of claim 9, further including a first data table stored in the memory and including associations of stress-strain signals to degrees of stress-strain.

12. The machine of claim 9, further including a second data table stored in the memory and including associations of stress-strain to one or more machine systems.

13. The machine of claim 9, wherein the processor identifies a failure mode of the stress-strain sensor, and disallows transmission of the reduced power control signal as a result of the identified failure mode.

14. A power limiting method using a power limiting stress-strain monitor system for a machine, the power limiting method including:

supporting a stress-strain sensor on a structural component of the machine;

receiving a signal from the stress-strain sensor at an electronic controller;

determining a degree of stress-strain at a location of the stress-strain sensor based on the signal using a processor of the electronic controller;

determining, using the processor, whether the degree of stress-strain is over a predetermined threshold;

identifying, using the processor, a machine system configured to accommodate the stress-strain based on a correlation of the stress-strain to the machine system from among a plurality of machine systems;

modifying a control signal to the machine system based on the degree of stress-strain when the degree of stress-strain is over the predetermined threshold; and controlling the machine system based on the control signal to limit output of the machine system, without disabling the machine system, wherein an amount of the limit to the output of the machine system correlates to the degree of stress-strain.

15. The power limiting method of claim 14, further including transmitting a reduced power control signal to the machine system based on the degree of stress-strain.

16. The power limiting method of claim 15, further including transmitting the reduced power control signal to one of a hydraulic power system, a mechanical power system, and an electro-mechanical power system based on the degree of stress-strain.

17. The power limiting method of claim 14, further including executing a closed loop algorithm, using the processor, including said determining the degree of stress-strain, said determining whether the degree of stress-strain is over a predetermined threshold, said identifying the machine system configured to accommodate the stress-strain, said modifying the control signal to the machine system based on the degree of stress-strain when the degree of stress-strain is over the predetermined threshold, and said controlling the machine system based on the control signal to limit output of the machine system.

18. The power limiting method of claim 17, wherein the closed loop algorithm includes identifying a failure mode of the stress-strain sensor, and disallowing modification of the control signal to the machine system as a result of the identified failure mode.

19. The power limiting method of claim 14, further including transmitting a notification corresponding to the stress-strain to an offboard entity.

* * * * *